US007721798B2

(12) United States Patent
Angman

(10) Patent No.: US 7,721,798 B2
(45) Date of Patent: May 25, 2010

(54) WIRELINE ENTRY SUB

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 21 days.

(21) Appl. No.: 11/995,919

(22) PCT Filed: Jul. 17, 2006

(86) PCT No.: PCT/CA2006/001188

§ 371 (c)(1),
(2), (4) Date: May 13, 2008

(87) PCT Pub. No.: WO2007/009246

PCT Pub. Date: Jan. 25, 2007

(65) Prior Publication Data

US 2008/0230216 A1 Sep. 25, 2008

Related U.S. Application Data

(60) Provisional application No. 60/595,607, filed on Jul. 19, 2005.

(51) Int. Cl.
*E21B 19/22* (2006.01)

(52) U.S. Cl. ..... 166/77.1; 166/241.5; 166/385

(58) Field of Classification Search ..... 166/77.1, 166/241.5, 385; 175/214
See application file for complete search history.

(56) References Cited

U.S. PATENT DOCUMENTS

| | | | | | |
|---|---|---|---|---|---|
| 2,262,364 | A * | 11/1941 | Hugel et al. | ..... | 166/77.1 |
| 2,370,818 | A | 3/1945 | Silverman | | |
| 2,567,009 | A | 9/1951 | Calhoun et al. | | |
| 2,569,390 | A | 9/1951 | Sewell | | |
| 2,630,180 | A * | 3/1953 | Summers | ..... | 166/77.1 |
| 2,693,858 | A * | 11/1954 | Osmun | ..... | 166/77.1 |
| 4,428,421 | A | 1/1984 | Rankin | | |
| 4,607,693 | A * | 8/1986 | Richardson | ..... | 166/65.1 |
| 4,681,162 | A | 7/1987 | Boyd | | |
| 4,899,816 | A * | 2/1990 | Mine | ..... | 166/85.5 |
| 4,913,227 | A * | 4/1990 | Wittrisch | ..... | 166/117.5 |
| 5,960,881 | A | 10/1999 | Allamon et al. | | |
| 6,202,764 | B1 | 3/2001 | Ables et al. | | |
| 6,843,321 | B2 * | 1/2005 | Carlsen | ..... | 166/355 |
| 6,913,084 | B2 | 7/2005 | Boyd | | |
| 7,503,397 | B2 * | 3/2009 | Giroux et al. | ..... | 166/77.1 |
| 2004/0094305 | A1 * | 5/2004 | Skjæ rseth et al. | ..... | 166/339 |
| 2005/0279512 | A1 * | 12/2005 | Boyd | ..... | 166/380 |

(Continued)

FOREIGN PATENT DOCUMENTS

| | | |
|---|---|---|
| CA | 1225021 | 1/1985 |

(Continued)

*Primary Examiner*—Jennifer H Gay
*Assistant Examiner*—Blake Michener
(74) *Attorney, Agent, or Firm*—Bracewell & Giuliani LLP

(57) ABSTRACT

A wireline entry sub includes a body for connection with a wellbore string of tubulars. An opening on the body extends a depth from a body outer surface to at least the longitudinal center axis. A wireline passage extends though the body from the opening to a lower end. A wireline pulling device is mounted on the sub body to apply pulling force to a wireline. The wireline pulling device ma be driven by a motor mounted on the wireline cut sub or by a to drive of a drilling rig.

17 Claims, 4 Drawing Sheets

U.S. PATENT DOCUMENTS

| | | | | |
|---|---|---|---|---|
| 2006/0032638 | A1 | 2/2006 | Giroux et al. | |
| 2007/0056722 | A1 | 3/2007 | Angman et al. | |
| 2008/0059073 | A1 | 3/2008 | Giroux et al. | |
| 2008/0196904 | A1 * | 8/2008 | Angman et al. | 166/387 |
| 2008/0230216 | A1 * | 9/2008 | Angman | 166/77.1 |

FOREIGN PATENT DOCUMENTS

| | | |
|---|---|---|
| CA | 2214798 | 9/1996 |
| CA | 2022144 | 3/1997 |
| GB | 2223253 | 4/1990 |

* cited by examiner

WIRELINE ENTRY SUB

FIELD OF THE INVENTION

The invention relates to an oil field tool for handling wireline and, in particular, a wireline entry sub.

BACKGROUND

Conventional oil field casing may be used as the drillstring for drilling oil and gas wells to simultaneously drill and case the wellbore. Once the wellbore is drilled to the desired depth, the casing is cemented into the earth without withdrawing it from the wellbore. A retrievable drilling assembly, including a bit and borehole enlarging tool, may be attached to the bottom end of the casing for drilling. This drilling assembly often includes other components such as mud motors, MWD collars, LWD collars, non-magnetic drill collars, steel drill collars, and stabilizers.

Once the casing is drilled to the desired casing setting depth, the drilling BHA is retrieved from the casing with a wireline before the casing is cemented in place. In some cases the BHA must be retrieved and replaced before the casing is drilled to its terminal depth, for example to replace a worn drill bit or to replace some other failed component in the BHA. A provision must be made for the wireline to be run through the casing to retrieve the BHA. It is often advantageous to circulate drilling fluid down the ID of the casing while the wireline is being run and the BHA recovered to assure that any influx of formation fluids is circulated out of the well in a controlled manner. It is also advantageous to reciprocate the casing while the BHA is being recovered so that the casing does not become stuck in the borehole. A top drive and a casing drive system may be used to support the casing to permit circulation and reciprocation of the casing. A top drive is often used to rotate the casing for drilling. The casing may be attached to the top drive with a casing drive system that grips the top of the casing without screwing into its upper threaded connection. The casing drive system also provides seals so that drilling fluid can be circulated down the inside diameter of the casing to flush cuttings away from the drill bit and up the annulus between the casing and the borehole wall.

The drilling rig used to drill with casing may be a specially designed rig that facilitates the efficient operation of the wireline for running and retrieving the drilling BHA. The rig also must be equipped with a wireline unit that is capable of handling the drilling BHAs. For rigs designed for casing drilling, this wireline unit may be provided as an integral part of the rig.

Access for the wireline is provided through the top of the swivel, which may be incorporated as an integral part of the top drive. The wireline access through the top of the swivel may be facilitated by utilizing a split crown block and split traveling block. Split blocks are ones where the sheaves used for carrying the drilling line are divided into two groups spaced laterally apart. The split crown arrangement allows a wireline sheave to be hung at the crown of the rig so the wireline can be aligned with the central axis of the drillstring. The split traveling block provides room for a wireline stripper assembly and wireline BOP to be attached to the top of the swivel to prevent the pressurized drilling fluid from escaping around the wireline as it is being run into and pulled from the casing. In some situations, it may be sufficient to provide only a split traveling block as the fleet angle from having the crown sheave offset slightly from the central axis of the drillstring.

The drilling BHA may be quite heavy and weigh as much as 30,000 pounds. A large braided cable, for example ¾" in diameter, may be required to support this much weight and the sheaves used with such a cable are relatively large in diameter, for example 30" in diameter. It is important that the sheaves and wireline pressure control equipment be positioned so that the wireline can enter the casing along its central axis. Otherwise, the cable will exert lateral forces on the casing or other equipment and will quickly cut into the equipment as it is run into and out of the well. In some situations, it may be advantageous to use a drilling rig that is designed specifically for drilling with casing when one is available. Often such a rig may not be available or only a portion of the well may be drilled with casing so that it may be more convenient to use a conventional rig.

There are only a few drilling rigs in the current fleet of rigs available for use in drilling oil and gas wells that are equipped as described above for using casing as the drillstring. It is possible to modify any drilling rig to include the facilities needed to easily handle the wireline when drilling with casing. Most conventional drilling rigs do not include split crown blocks and split traveling blocks to facilitate wireline access along the central axis of the drillstring. The time required to modify the rig to accommodate these parts and the capital cost of the modifications may not be justified when the rig is used to drill only a portion of a well with casing. Furthermore, the owner of the rig may not allow structural changes to be made to the rig. This is particularly true for expensive offshore rigs.

There are devices described in the prior art for providing wireline access to the ID of a drillstring. For example, U.S. Pat. No. 6,202,764 describes a wireline entry sub that can facilitate wireline use on a rig. Although such a wireline entry sub has been described, it is desirable that an improved sub be provided.

For example, in some cases, particularly for offshore rigs, the space for placing a wireline reel and tensioning unit near the drilling floor may be limited. Therefore, the wireline unit may be placed away from the rig floor. However, the wireline, which may be operating under a high-tension load, may be a hazard to rig personnel moving about the area.

SUMMARY

In accordance with a broad aspect of the present invention, there is provided a wireline entry sub, comprising: a body including an upper end, a lower end and a longitudinal, center axis therebetween, the body adapted for use with a wellbore string of tubulars; an opening on the body open a depth from a body outer surface to at least the longitudinal center axis; a wireline passage extending through the body from the opening to open adjacent the lower end; and a wireline pulling device on the sub body to apply pulling force to a wireline.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Although many different embodiments of the invention are possible, with reference to the figures as appropriate. It is understood that while the invention is described below in use with wireline (whether "slick line", braided cable, electric line, etc.), the invention is not limited to use with wireline, rather other small diameter conduits such as coiled tubing may be used with it as well.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
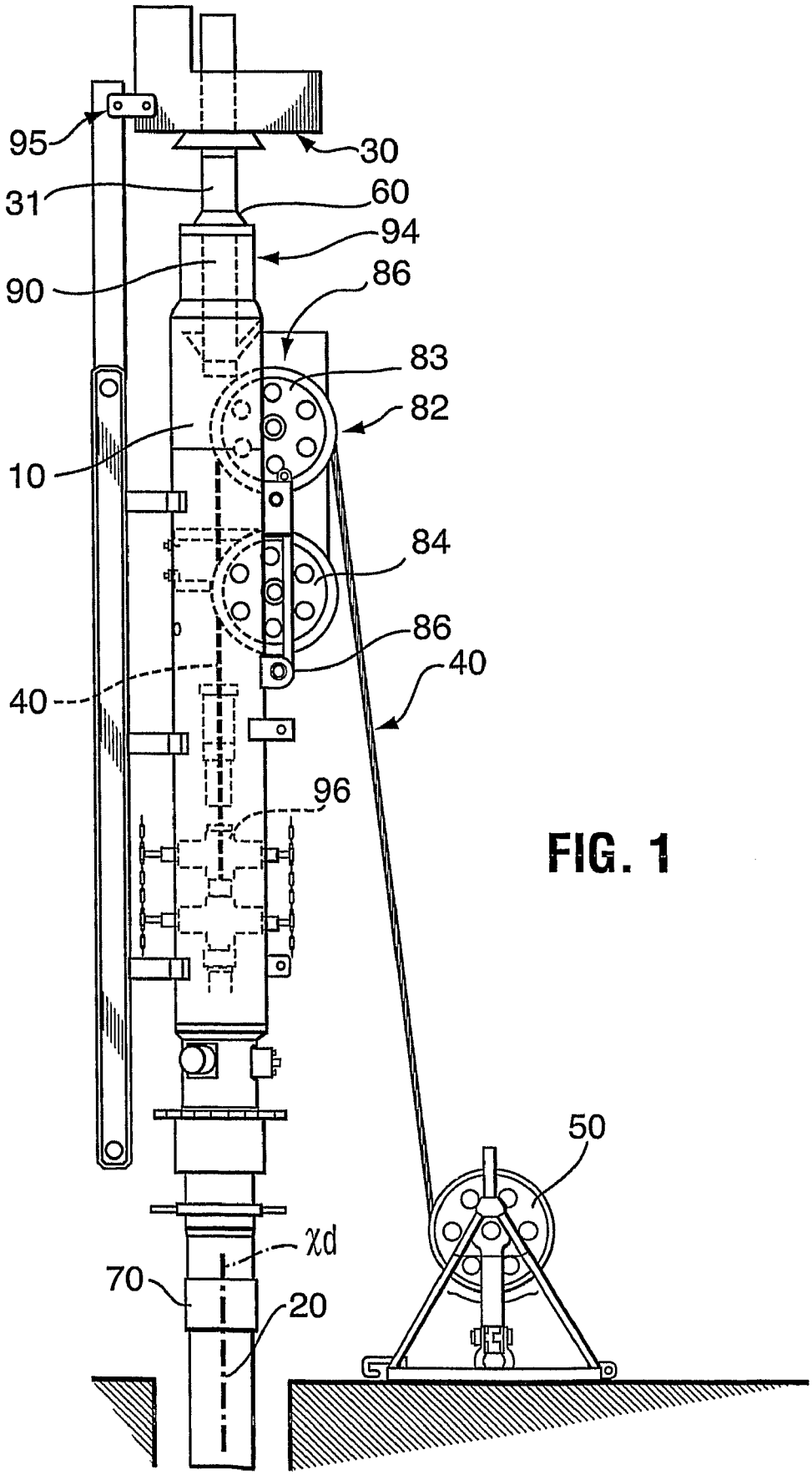
FIG. 1 is a side elevation view of one embodiment of a wireline entry assembly of the present invention in an operational setting with some internal components shown in phantom.

FIG. 1 shows a wireline entry assembly in an operational setting, including an entry sub 10 made up in a drill string 20 in conjunction with a top drive unit 30. A wireline 40 passes from a storage reel 50, through a traction head 82, into entry sub 10 and, thereafter, downhole. While a top drive unit is shown, it is to be understood that the entry sub could be installed in communication with a drill string in other ways. For example, a wireline entry sub could be supported in a rig, such as by being supported from the hook of a rig.

Figure 2:
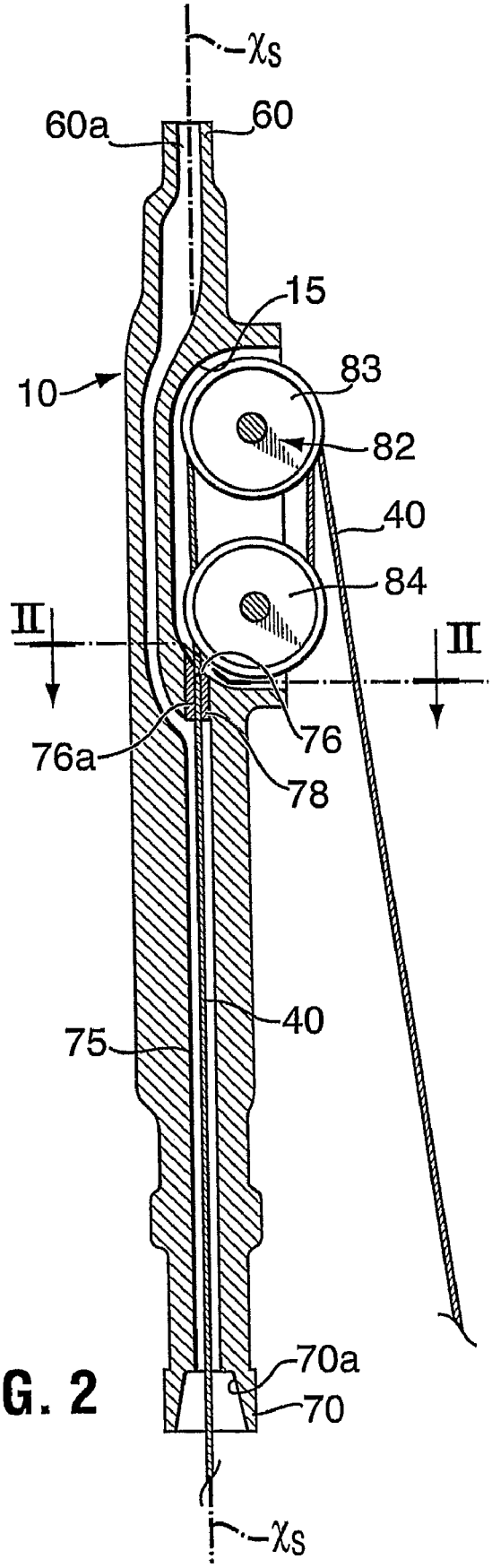
FIG. 2 is a sectional view through another wireline entry sub.
Figure 3:
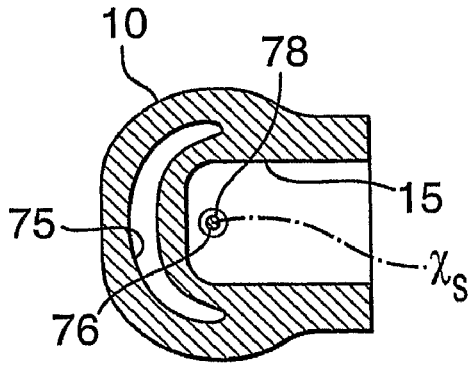
FIG. 3 is a sectional view along line II-II of FIG. 2.

FIGS. 2 and 3 show detailed views of entry sub 10. Entry sub 10 has a generally elongated tubular central body including an upper end 60 and a lower end 70. Upper end 60 has a bore 60*a* therethrough and lower end 70 has a bore 70*a* therethrough. Fluid passage 75 extends to fluidly connect upper end bore 60*a* and lower end bore 70*a*. A flow-through fluid path therefore exists through the entire length of entry sub 10, which permits fluid circulation down through the entry sub and the drill string using the existing rig pumping equipment. In this embodiment, fluid passage 75 extends through the sub body about opening 15 (see FIGS. 2 and 3) to connect upper end bore 60*a* and lower end bore 70*a*. Thus, the flow-through fluid path is maintained about the opening to permit fluid circulation down through the entry sub.

Upper and lower ends 60, 70 are adapted to connect into drill string 20 directly or indirectly below top drive 30, one example of which is shown in FIG. 1. As such, in one embodiment ends 60, 70 may be formed as threaded connections to permit in-line threaded connection to drill string 20. Alternately, end 60 may have an inside or an outside diameter formed to be gripped by, or attach to, a tubular gripping device, such as by a casing gripping tool available from Tesco Corporation. In another embodiment, lower end 70 may be formed to grip drill string 20 in any of various ways. Alternately, another gripping device, such as for example, an elevator, may be employed between the entry sub and the drill string to support the drill string at the lower end of the entry sub. However, it is to be understood that various forms of connection may be employed.

Upper and lower ends 60, 70 may have a common center axis Xs that is not angled or displaced from the center axis Xd of drill string 20, but instead is substantially coincident therewith, as shown for example in FIG. 1. When entry sub 10 is made up in drill string 20 and engaged by a top drive, the entirety of drill string 20 may be lifted by raising the top drive unit 30 with the rig drawworks. Accordingly, entry sub 10 is made of materials and has dimensions sufficient to give entry sub 10 sufficient tensile strength to lift drill string 20. By way of example only, entry sub 10 may be made of high strength carbon steel, stainless steel, or other similar materials. The "straight-line" aspect of the tool, that is, the center or lift axis of entry sub 10 being substantially coincident with the center axis of drill string 20, results in no undesirable bending moment or canting when drill string 20 is lifted with entry sub 10 in place.

Entry sub 10 has an opening 15 formed between upper and lower ends 60 and 70. Opening 15 extends a depth into the sub at least ½ the sub's outer diameter so that opening 15 is open to the sub center axis Xs. Opening 15 may take various forms. For example, in one embodiment an intermediate body portion of the sub is formed as a hollow tube such that opening may be defined as the entire hollow space within the tube. A wireline entry port 76 may be formed in the opening to provide access to a passage 76*a* through which the wireline may extend through the entry sub toward its lower end. In the illustrated embodiment, entry port 76 is formed as a hole in the base of opening 15. In another embodiment, the port may be an enlarged opening through the end of the entry sub through which wireline may pass before entering a smaller port on a component such as a pack off or blow out preventer connected adjacent the lower end of or below the entry sub. Passage 76*a* in the illustrated embodiment opens into fluid passage 75 or bore 70*a* of the lower end. A seal assembly 78 may be mounted in port 76 to seal about wireline passage therethrough into bore 70*a* of lower end 70, and thence into the bore of drill string 20 leading downhole. Bore 70*a* and the aperture through seal assembly 78 may be substantially concentric with the center axis Xs of sub 10 and of drill string 20.

Traction head 82 is connected to entry sub 10 in association with opening 15. Traction head 82 includes one or more traction generating members such as a driven sheave 83 for generating a pull force on the wireline. In the illustrated embodiment, traction head 82 includes a driven sheave 83 and an idler sheave 84. The idler sheave may also be driven, if desired.

In the one embodiment, traction head 82 may be connected to entry sub 10 via a bracket 86. Wireline 40 passes through traction head 82, through seal assembly 78 and through lower end 70 before passing downhole. Traction head 82 is positioned and/or configured such that wireline 40 roved through it comes off adjacent seal assembly 78 and may be substantially aligned with the center axis of both lower end 70 and drill string 20. Wireline 40 may therefore enter seal assembly 78 in a "straight line" position with respect to the center axis of drill string 20, as readily seen in the Figures.

Traction head 82 may be driven in various ways, as by use of motors mounted on the entry sub or spaced therefrom but in communication with the traction head. However, if a top drive is available in the rig, it may be worth considering that a top drive 30 often cannot be used to rotate the drill string while wireline operations are in progress because rotating the drill string with the wireline inside it might damage the wireline and it has been determined that the power rating of the top drive may be approximately the same as that needed to drive a wireline driven sheave. Thus, the sub may include a drive mechanism for the traction head that is connectable for drive communication to top drive 30. The drive mechanism may include for example a drive shaft 90 connectable at one end to receive rotational drive from the quill 31 of top drive 30. At an opposite end, drive shaft 90 includes a connection to a drive mechanism of traction head 82. As such, the rotational power of the top drive can be used to directly power traction head 82 on the entry sub. Thus, traction head 82 can exert the required pulling force to trip the wireline through drill string 20, but the high-tension wireline is contained in a small, relatively low risk area between driven sheave 83 and seal assembly 78, which are mounted close and possibly directly adjacent each other on the entry sub itself. Storage reel 50 is used to roll up the wireline, but it can be positioned safely and conveniently almost anywhere on the rig with any tension in the wireline adjacent the storage reel being significantly less than that tension in the wireline extending between the seal assembly and the driven sheave. In addition, storage reel 50 could be substantially smaller than a reel intended also to develop wireline pulling capacity. Storage reel 50 may be positioned on the rig floor, as shown, if there is adequate space for it. Alternately, the storage reel may be positioned elsewhere with possibly an intermediate sheave between traction head 82 and storage reel 50 to appropriately direct the wireline. Storage reel 50 may require a small power unit to pick up the slack created by traction head during wireline retrieval from downhole.

Drive shaft 90 may take various forms to act to transmit the top drive power to drive the traction head. In one embodiment, for example, drive shaft 90 includes a ring gear attached to the driven sheave and formed to engage a pinion gear on the top drive shaft. In another embodiment, the drive shaft may be connected to the top drive shaft and may be formed to operate a hydraulic motor for the driven sheave. These drive arrangements convert the rotation of the top drive shaft to rotation of a drive shaft of the traction head. The drive mechanism of the wireline sub may also operate to reduce the rotational speed of the top drive output shaft relative to the driven sheave.

A swivel bearing 94 may be connected between upper end 60 and quill 31 to permit the quill and drive shaft 90 to rotate without imparting rotation to the sub itself so that the sub may remain rotationally stationary while the drive shaft is driven therein. A connection 95 may be provided between entry sub 10 and a non-rotating portion of top drive 30, if desired, to further stabilize the entry sub.

In a typical use, entry sub 10 is positioned in the rig above drill string 20 by any of various means. In the illustrated embodiment, entry sub 10 is connected below top drive 30 as by threading, gripping, etc. and above drill string by threading, gripping, spears, packers, seals etc. Thereafter, wireline 40 from reel 50 is roved about traction head 82, through seal assembly 78, and out through lower end 70. Wireline tools may then be connected to wireline 40 and lowered into drill string 20. Once the drill string, entry sub 10 and top drive 30 are connected, the top drive may be driven to rotate drive shaft 90 to drive traction head 82. Wireline entry sub 10 and head 82 thereby feeds wireline in or out of the well as desired to position tools at a desired downhole depth or to retrieve tools from the hole. All or substantially all rigging of the wireline sub and wireline tools may be done from the relative safety of the rig floor. Control of the head may be achieved through the top drive controls such that a separate wireline control panel need not be provided, if desired.

Lift forces on drill string 20 with entry sub 10 in place are axial. For example, with entry sub 10 of the present invention, the lift axis of the entry sub is substantially coincident with the center axis of the drill string, and no torque or bending moments are transferred to drill string 20 upon lifting drill string 20 with entry sub 10 in place.

A positive flow control valve (commonly known in the industry as a "TIW" valve) may be placed in drill string 20 below entry sub 10, to permit pressure isolation of drill string 20 while entry sub 10 along with wireline and wireline tools are rigged up.

In certain operational situations where wireline operations are conducted under high pressure a wireline blow out preventer assembly 96 may be employed in lower end 70 or may be positioned in a sub below sub 10, in addition to or alternately from seal assembly 78.

Figure 4:
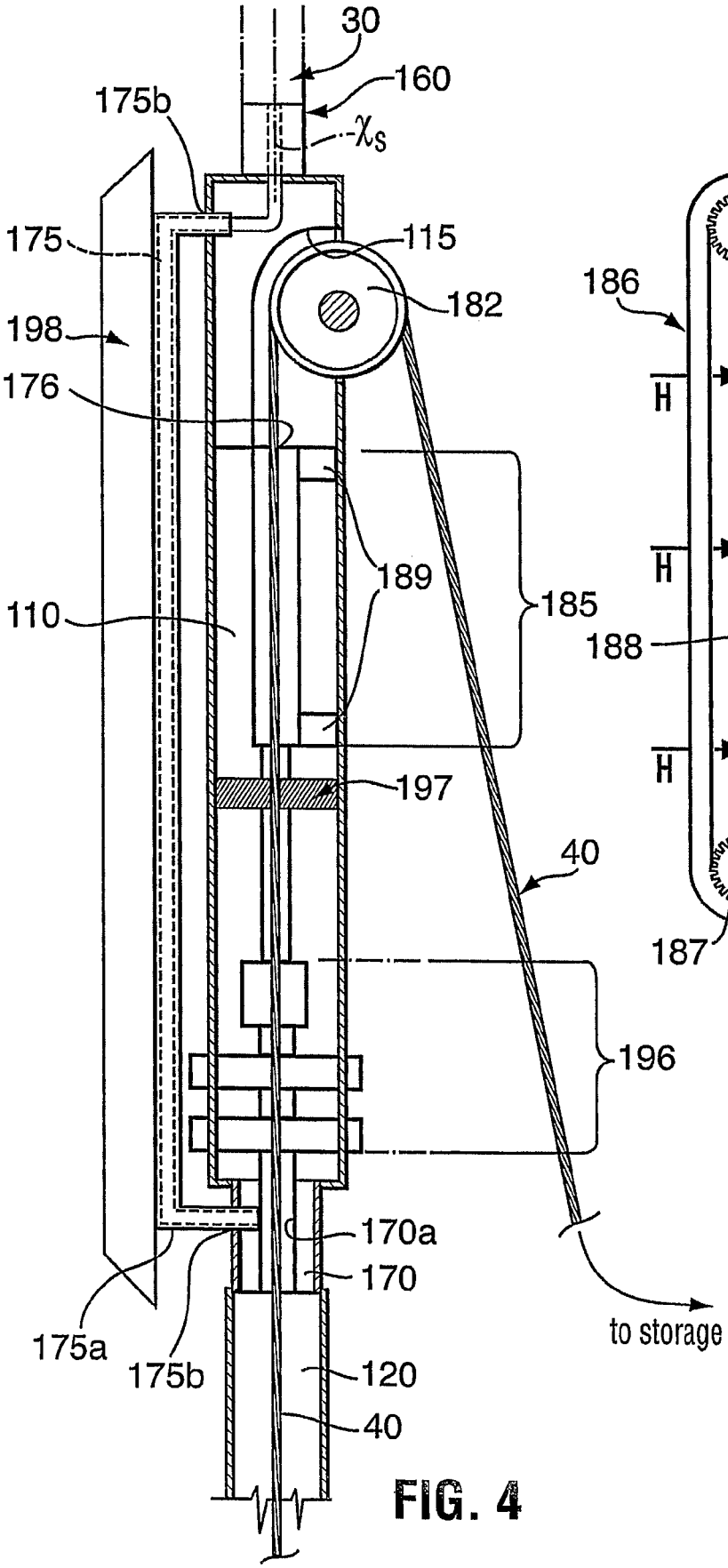
FIG. 4 is a schematic sectional view through another wireline entry sub.
Figure 5:
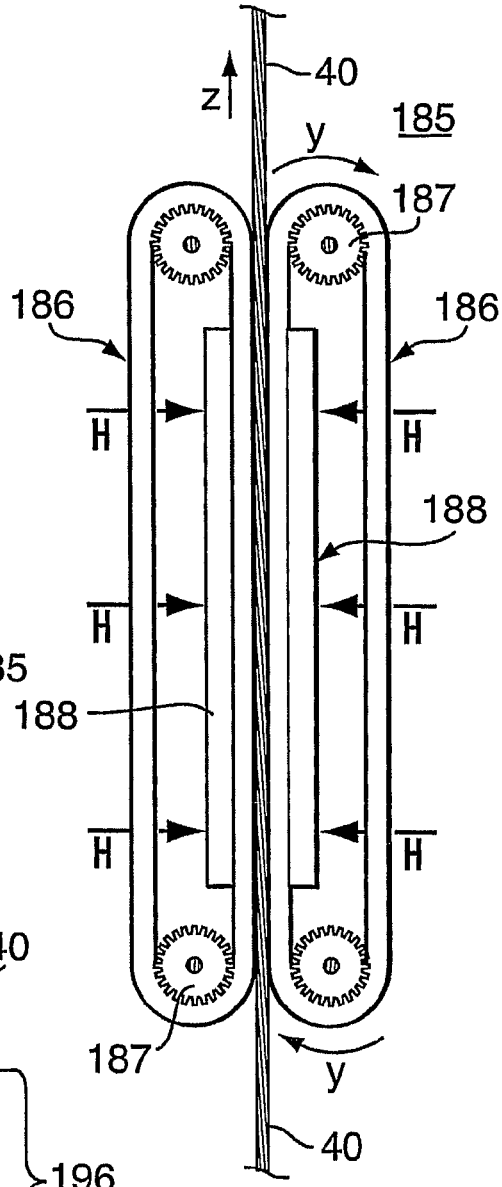
FIG. 5 is an enlarged view of one possible linear wireline puller useful in a wireline entry sub.
Figure 6:
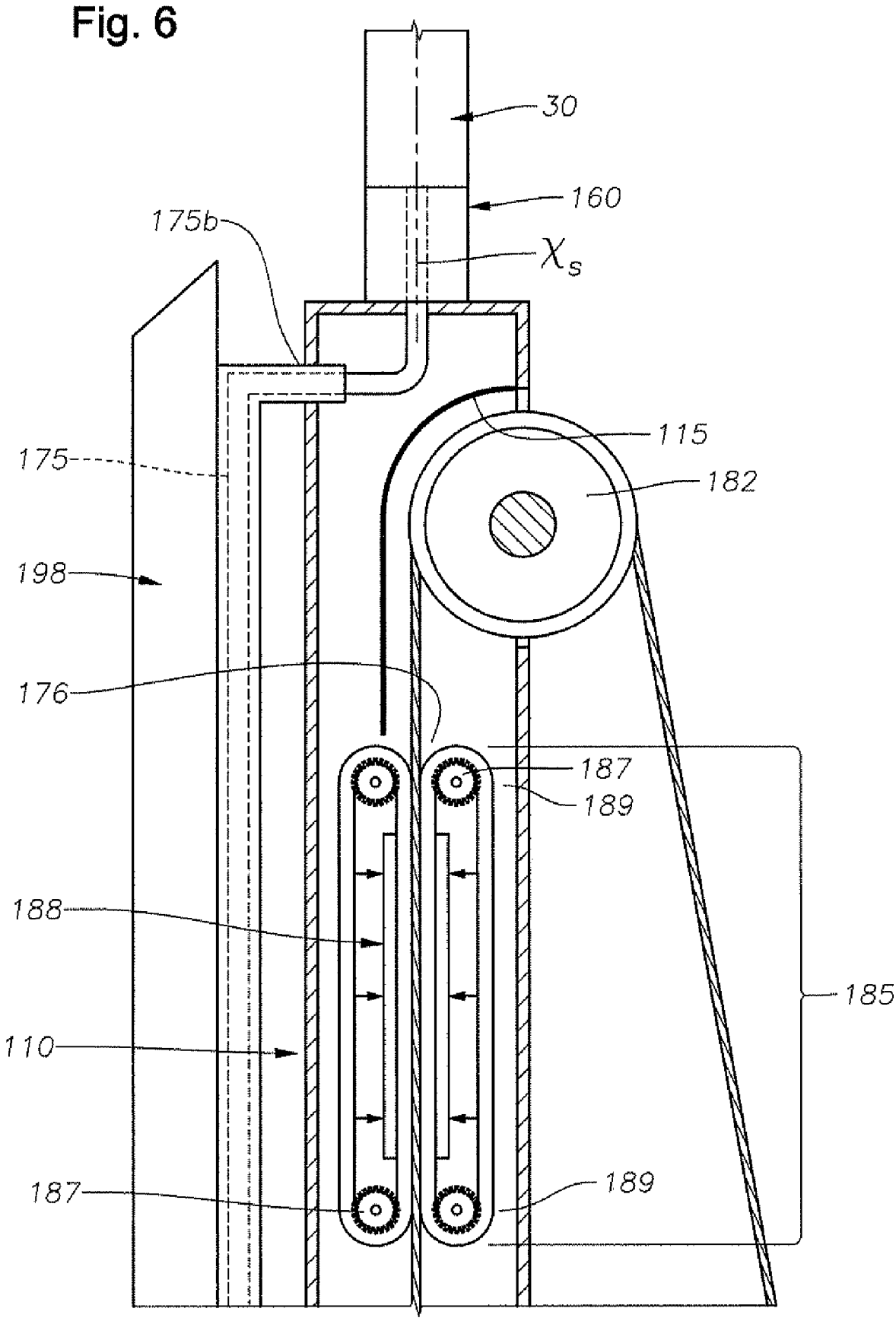
FIG. 6 is an enlarged view of a portion of the wireline entry sub of FIG. 4 with the linear wireline puller of FIG. 5 shown installed.

Referring to FIGS. 4-6, another embodiment is shown including another wireline fraction arrangement on a wireline entry sub 110. Entry sub 110 has a generally elongate central body comprising an upper end 160 and a lower end 170. Upper end 160 has a bore therethrough and lower end 170 has a bore 170*a* therethrough. In this embodiment, a fluid bypass 175 extends to fluidly connect the upper end bore and lower end bore 170*a*. Fluid bypass 175 is formed through a tube 175*a* extending alongside the sub body and connected to ports 175*b* through the sub body. Fluid bypass 175 provides for fluid circulation down though the entry sub and the drill string using the existing rig pumping equipment, but avoids the need to bore a passage about the opening area, which may weaken the body at that point. In one embodiment, an external line such as tube 175*a* may extend beyond the lower end to a component connected therebelow such that fluid bypasses lower end 170 altogether.

Upper end 160 is adapted to connect directly or indirectly to top drive 30 and lower end 170 is formed to support one or more tubulars 120 connected therebelow. As such, ends 160, 170 may be formed as threaded connections to permit in-line threaded connection to a drill string. However, it is to be understood that other forms of connection may be employed.

Entry sub 110 has an opening 115 formed between upper and lower ends 160 and 170. Opening 115 extends a depth into the sub at least ½ the sub's central body outer diameter so that opening 115 is open to the sub center axis Xs. A wireline entry port 176 is formed in the base of opening 115 and extends along center axis Xs to open into bore 170*a* of the lower end.

In this embodiment, a sheave 182 is mounted in association with opening 115 to accept and guide wireline 40 between a supply reel (not shown) and through entry port 176. Sheave 183 is positioned such that wireline 40 may come off substantially aligned with the center axis of both lower end 170 and the tubulars 20 connected therebelow to pass through sub 110 and downhole in a "straight line".

Also in this illustrated embodiment, wireline pulling force is applied by a linear wireline puller 185 mounted in entry port 176. Wireline puller 185 may be embodied in various ways. In one embodiment, for example, wireline puller 185 includes a pair of facing drive chains 186 or conveyors that are biased together to engage and drive wireline 40 therebetween. Although various mechanisms are possible, in one embodiment, continuous drive chains 186 are driven on gears 187 such that rotation in direction y drives wireline movement in direction z. Pressure plates 188 may bias, as by hydraulic force arrows H, the chains together. The chains may include an elastomeric contact surface to reduce or eliminate any crushing damage to the wireline and to create a high friction coefficient against the wireline, if desired, to enhance grip of the wireline.

Linear wireline puller 185 may be connected to a drive mechanism 189 for conveying power from top drive 30 or from another source such as a hydraulic or electric motor. The drive mechanism may include for example gear mechanisms, hydraulic pump/motor systems, as previously described or various other means.

In this embodiment, linear wire puller 185, when driven to operate, can exert the required pulling force to trip the wireline through tubulars 20, but the high-tension wireline is contained within the body of entry sub. This provides an extra measure of safety even over the embodiment of FIGS. 1, 2 and 3.

Wireline entry port 176 may include a wireline blow out preventer assembly 196, wireline cleaner 197 or other devices, as desired. Alternately, these or other components may be positioned in subs connected below sub 110.

If desired to facilitate handling, a wireline entry sub may include a transportation skid 198, as is shown in FIG. 3.

Of course the embodiments shown and described herein can be modified in various ways. For example, various approaches may be taken to install the entry sub in a rig, to permit fluid conveyance through or about the entry sub as by internal or external fluid passages, or by introduction of fluid to a lower end of the sub or therebelow. As another example, other wireline pulling mechanisms or top drive-connectable drive mechanisms could be used.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. An apparatus for retrieving a downhole well tool, comprising:

a body including an upper end, a lower end and a longitudinal, center axis therebetween, the body adapted for use with a wellbore string of tubulars;

a wireline passage extending through the body;

a wireline extending through the wireline passage for deployment in the string of tubulars in engagement with a downhole well tool;

a wireline pulling device on the body in engagement with the wireline to apply a pulling force to the wireline; and a drive mechanism mounted to the body for driving the wireline pulling device; and the body is used with a top drive; and the drive mechanism is connected with the top drive for communicating drive forces from the top drive to the wireline pulling device.

2. The apparatus of claim 1 wherein the wireline pulling device includes a traction head comprising a sheave mounted on the body, the sheave being driven in rotation by the drive mechanism.

3. The apparatus of claim 2 wherein the traction head is positioned such that the wireline coming off the traction head is substantially coincident with the axis.

4. The apparatus of claim 1 wherein the wireline pulling device comprises a linear wireline puller having a pair of conveyors driven by the drive mechanism, the conveyors being biased toward each other and into gripping engagement with the wireline, which is located between them.

5. The apparatus of claim 4 wherein the each of the conveyors comprises a chain arranged in a loop.

6. The apparatus of claim 1, further comprising:

a storage reel remotely located from the body; the wireline being wrapped around the storage reel and extending from the storage reel to the wireline pulling device; and a length of the wireline extending from the wireline pulling device to the storage reel is isolated from tension caused by the wireline pulling device exerting the pulling force on the wireline.

7. The apparatus of claim 1, further comprising:

a storage reel remotely located from the body, the wireline being wrapped around the storage reel and extending from the storage reel to the wireline pulling device; and wherein the storage reel is rotated independently of the drive mechanism for the wireline pulling device.

8. The apparatus of claim 1 wherein the wireline pulling device comprises:

a first sheave mounted on the body, the first sheave being driven in rotation by the drive mechanism, the wireline extending around the first sheave; and a second sheave mounted to the sub body and axially spaced from the first sheave, the wireline also extending around the second sheave.

9. The apparatus of claim 1 further comprising a fluid passage positioned to convey fluid through at least art the wireline passage into the string of tubulars.

10. The apparatus of claim 9 wherein the fluid passage includes an external conduit that is external of the sub body and joins the wireline passage below a point where the wireline enters the wireline passage.

11. The apparatus of claim 10 further comprising a wireline blowout preventer mounted to the sub body above a point where the external conduit joins the wireline passage.

12. The apparatus of claim 1 further comprising a wireline blow out preventer mounted within the entry sub above a lower end of the entry sub.

13. A wireline entry sub, comprising:

a body having upper and lower ends, a longitudinal axis, and adapted to be connected to a wellbore string of tubulars;

a wireline passage extending axially downward through the body and out the lower end;

a sheave mounted to the body above the wireline passage, the sheave adapted to receive a wireline for deployment into the string of tubulars; and a drive mechanism mounted to the entry sub for rotatably driving the sheave; and wherein the drive mechanism comprises a drive shaft carried by the body and is cooperatively engaged with and driven by a top drive of a drilling rig.

14. The wireline entry sub of claim 13, wherein the drive mechanism comprises a motor carried by the body.

15. The wireline entry sub of claim 13, further comprising:

a storage reel mounted remotely from the body; and wherein the drive mechanism rotates the sheave independently of the storage reel.

16. A wireline entry sub, comprising:

a body having upper and lower ends, a longitudinal axis, and adapted to be connected to a wellbore string of tubulars;

a wireline passage extending axially downward through the body and out the lower end;

a pair of axially extending conveyors mounted on opposite sides of the axis above the wireline passage for gripping the wireline between them and exerting a pulling force on the wireline, each of the conveyors extending in an endless loop; and a drive mechanism mounted to the entry sub for rotatably driving the conveyors; and wherein the drive mechanism comprises a drive shaft rotated by a top drive of a drilling rig, the drive shaft being coupled to the conveyors.

17. The wireline entry sub according to claim 16, wherein the drive mechanism comprises a motor carried by the body.

* * * * *